US009741350B2

(12) United States Patent
Atti et al.

(10) Patent No.: US 9,741,350 B2
(45) Date of Patent: Aug. 22, 2017

(54) SYSTEMS AND METHODS OF PERFORMING GAIN CONTROL

(71) Applicant: QUALCOMM Incorporated, San Diego, CA (US)

(72) Inventors: Venkatraman Srinivasa Atti, San Diego, CA (US); Venkatesh Krishnan, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 94 days.

(21) Appl. No.: 13/959,090

(22) Filed: Aug. 5, 2013

(65) Prior Publication Data

US 2014/0229170 A1 Aug. 14, 2014

Related U.S. Application Data

(60) Provisional application No. 61/762,803, filed on Feb. 8, 2013.

(51) Int. Cl.

| | |
|---|---|
| ***G10L 19/03*** | (2013.01) |
| ***G10L 21/0264*** | (2013.01) |
| *G10L 21/038* | (2013.01) |

(52) U.S. Cl.

CPC ..... *G10L 19/03* (2013.01); *G10L 21/0264* (2013.01); *G10L 21/038* (2013.01)

(58) Field of Classification Search

CPC ..... G10L 19/03
USPC ..... 704/225
See application file for complete search history.

(56) References Cited

U.S. PATENT DOCUMENTS

| | | | | |
|---|---|---|---|---|
| 6,263,307 | B1 | 7/2001 | Arslan et al. | |
| 6,453,289 | B1 | 9/2002 | Ertem et al. | |
| 7,272,556 | B1 | 9/2007 | Aguilar et al. | |
| 7,680,653 | B2 | 3/2010 | Yeldener | |
| 8,615,092 | B2 * | 12/2013 | Matsuo | H04S 7/30 381/1 |
| 2004/0049380 | A1 * | 3/2004 | Ehara | G10L 19/012 704/219 |

(Continued)

FOREIGN PATENT DOCUMENTS

| | | | |
|---|---|---|---|
| JP | H04230800 | A | 8/1992 |
| JP | 2000221998 | A | 8/2000 |

(Continued)

OTHER PUBLICATIONS

International Search Report and Written Opinion for International Application No. PCT/US2013/053791, mailed Feb. 17, 2014, 12 pages.

(Continued)

*Primary Examiner* — David Hudspeth
*Assistant Examiner* — Shreyans Patel
(74) *Attorney, Agent, or Firm* — Toler Law Group, P.C.

(57) ABSTRACT

A particular method includes determining, based on an inter-line spectral pair (LSP) spacing corresponding to an audio signal, that the audio signal includes a component corresponding to an artifact-generating condition. The method also includes, in response to determining that the audio signal includes the component, adjusting a gain parameter corresponding to the audio signal. For example, the gain parameter may be adjusted via gain attenuation and/or gain smoothing.

37 Claims, 6 Drawing Sheets

(56) References Cited

U.S. PATENT DOCUMENTS

| | | | | |
|---|---|---|---|---|
| 2005/0004793 | A1* | 1/2005 | Ojala | G10L 21/038 704/219 |
| 2006/0277038 | A1 | 12/2006 | Vos et al. | |
| 2006/0277039 | A1 | 12/2006 | Vos et al. | |
| 2006/0277042 | A1 | 12/2006 | Vos et al. | |
| 2008/0027716 | A1 | 1/2008 | Rajendran et al. | |
| 2008/0126086 | A1 | 5/2008 | Vos et al. | |
| 2008/0208575 | A1 | 8/2008 | Laaksonen et al. | |
| 2009/0192803 | A1* | 7/2009 | Nagaraja | G10L 19/012 704/278 |
| 2010/0036656 | A1* | 2/2010 | Kawashima | G10L 21/0364 704/205 |
| 2011/0099004 | A1* | 4/2011 | Krishnan | G10L 21/038 704/206 |
| 2011/0191849 | A1 | 8/2011 | Jayaraman et al. | |
| 2011/0295598 | A1* | 12/2011 | Yang | G10L 21/038 704/205 |
| 2012/0047577 | A1 | 2/2012 | Costinsky | |

FOREIGN PATENT DOCUMENTS

| | | | |
|---|---|---|---|
| WO | 2012110447 | A1 | 8/2012 |
| WO | 2012158157 | A1 | 11/2012 |

OTHER PUBLICATIONS

Pellom, B.L., et al., "An Improved (Auto:I, LSP:T) Constrained Iterative Speech Enhancement for Colored Noise Environments," IEEE Transactions on Speech and Audio Processing, vol. 6, No. 6, Nov. 1998, IEEE, Piscataway, NJ, pp. 573-579.

* cited by examiner

SYSTEMS AND METHODS OF PERFORMING GAIN CONTROL

I. CROSS-REFERENCE TO RELATED APPLICATIONS

The present application claims priority from commonly owned U.S. Provisional Patent Application No. 61/762,803 filed on Feb. 8, 2013, the content of which is expressly incorporated herein by reference in its entirety.

II. FIELD

The present disclosure is generally related to signal processing.

III. DESCRIPTION OF RELATED ART

Advances in technology have resulted in smaller and more powerful computing devices. For example, there currently exist a variety of portable personal computing devices, including wireless computing devices, such as portable wireless telephones, personal digital assistants (PDAs), and paging devices that are small, lightweight, and easily carried by users. More specifically, portable wireless telephones, such as cellular telephones and Internet Protocol (IP) telephones, can communicate voice and data packets over wireless networks. Further, many such wireless telephones include other types of devices that are incorporated therein. For example, a wireless telephone can also include a digital still camera, a digital video camera, a digital recorder, and an audio file player.

In traditional telephone systems (e.g., public switched telephone networks (PSTNs)), signal bandwidth is limited to the frequency range of 300 Hertz (Hz) to 3.4 kiloHertz (kHz). In wideband (WB) applications, such as cellular telephony and voice over internet protocol (VoIP), signal bandwidth may span the frequency range from 50 Hz to 7 kHz. Super wideband (SWB) coding techniques support bandwidth that extends up to around 16 kHz. Extending signal bandwidth from narrowband telephony at 3.4 kHz to SWB telephony of 16 kHz may improve the quality of signal reconstruction, intelligibility, and naturalness.

SWB coding techniques typically involve encoding and transmitting the lower frequency portion of the signal (e.g., 50 Hz to 7 kHz, also called the "low-band"). For example, the low-band may be represented using filter parameters and/or a low-band excitation signal. However, in order to improve coding efficiency, the higher frequency portion of the signal (e.g., 7 kHz to 16 kHz, also called the "high-band") may not be fully encoded and transmitted. Instead, a receiver may utilize signal modeling to predict the high-band. In some implementations, data associated with the high-band may be provided to the receiver to assist in the prediction. Such data may be referred to as "side information," and may include gain information, line spectral frequencies (LSFs, also referred to as line spectral pairs (LSPs)), etc. High-band prediction using a signal model may be acceptably accurate when the low-band signal is sufficiently correlated to the high-band signal. However, in the presence of noise, the correlation between the low-band and the high-band may be weak, and the signal model may no longer be able to accurately represent the high-band. This may result in artifacts (e.g., distorted speech) at the receiver.

IV. SUMMARY

Systems and methods of performing gain control are disclosed. The described techniques include determining whether an audio signal to be encoded for transmission includes a component (e.g., noise) that may result in audible artifacts upon reconstruction of the audio signal. For example, the signal model may interpret the noise as speech data, which may result in erroneous gain information being used to represent the audio signal. In accordance with the described techniques, in the presence of noisy conditions, gain attenuation and/or gain smoothing may be performed to adjust gain parameters used to represent the signal to be transmitted. Such adjustments may lead to more accurate reconstruction of the signal at a receiver, thereby reducing audible artifacts.

In a particular embodiment, a method includes determining, based on an inter-line spectral pair (LSP) spacing corresponding to an audio signal, that the audio signal includes a component corresponding to an artifact-generating condition. The method also includes, in response to determining that the audio signal includes the component, adjusting a gain parameter corresponding to the audio signal.

In another particular embodiment, the method includes comparing an inter-line spectral pair (LSP) spacing associated with a frame of an audio signal to at least one threshold. The method also includes adjusting a speech coding gain parameter corresponding to the audio signal (e.g., a codec gain parameter for a digital gain used in a speech coding system) at least partially based on a result of the comparing.

In another particular embodiment, an apparatus includes a noise detection circuit configured to determine, based on an inter-line spectral pair (LSP) spacing corresponding to an audio signal, that the audio signal includes a component corresponding to an artifact-generating condition. The apparatus also includes a gain attenuation and smoothing circuit responsive to the noise detection circuit and configured to, in response to determining that the audio signal includes the component, adjust a gain parameter corresponding to the audio signal.

In another particular embodiment, an apparatus includes means for determining, based on an inter-line spectral pair (LSP) spacing corresponding to an audio signal, that the audio signal includes a component corresponding to an artifact-generating condition. The apparatus also includes means for adjusting a gain parameter corresponding to the audio signal in response to determining that the audio signal includes the component.

In another particular embodiment, a non-transitory computer-readable medium includes instructions that, when executed by a computer, cause the computer to determine, based on an inter-line spectral pair (LSP) spacing corresponding to an audio signal, that the audio signal includes a component corresponding to an artifact-generating condition. The instructions are also executable to cause the computer to adjust a gain parameter corresponding to the audio signal in response to determining that the audio signal includes the component.

Particular advantages provided by at least one of the disclosed embodiments include an ability to detect artifact-inducing components (e.g., noise) and to selectively perform gain control (e.g., gain attenuation and/or gain smoothing) in response to detecting such artifact-inducing components, which may result in more accurate signal reconstruction at a receiver and fewer audible artifacts. Other aspects, advantages, and features of the present disclosure will become apparent after review of the entire application, including the following sections: Brief Description of the Drawings, Detailed Description, and the Claims.

V. BRIEF DESCRIPTION OF THE DRAWINGS

VI. DETAILED DESCRIPTION

Figure 1:
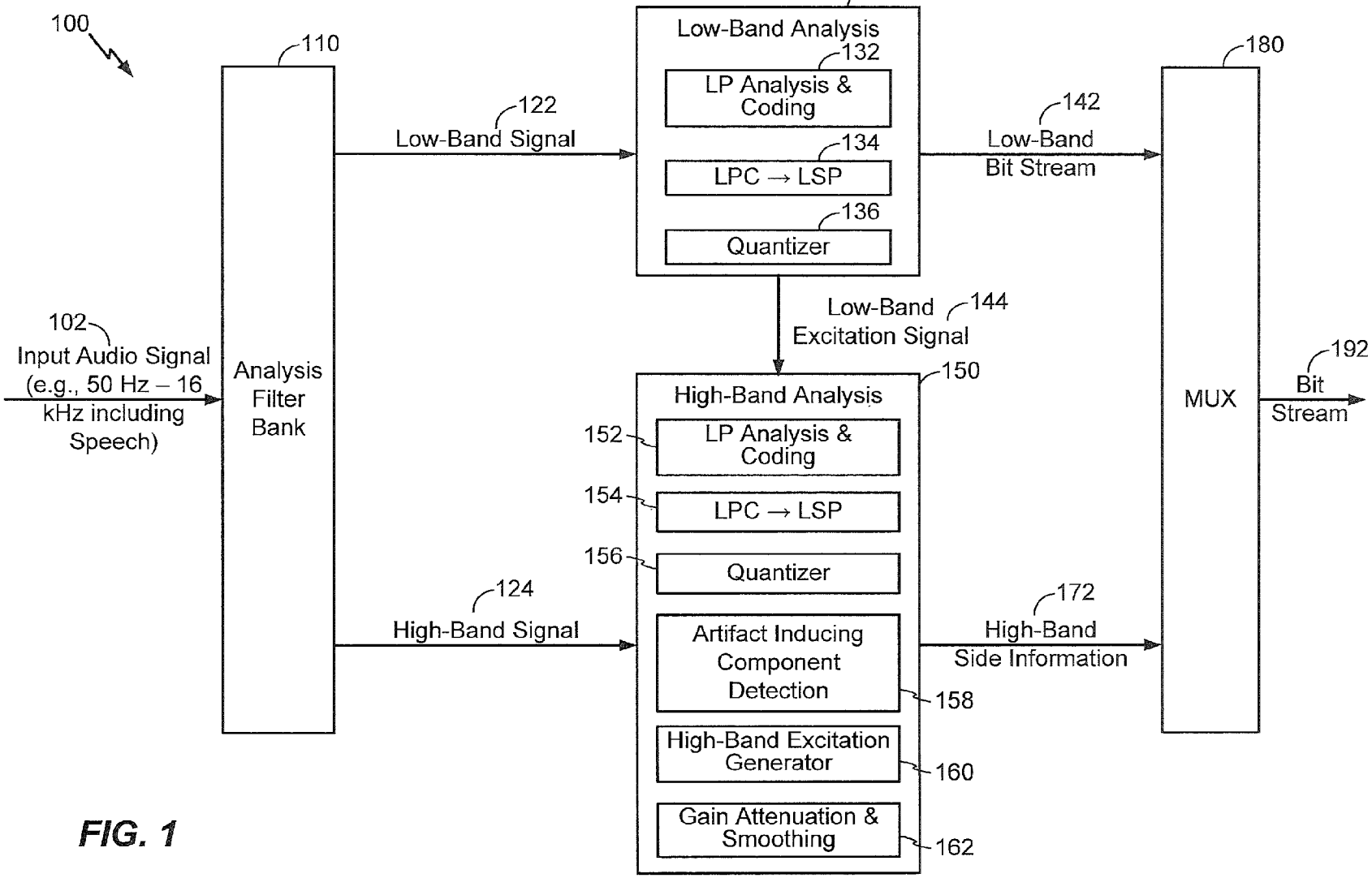
FIG. 1 is a diagram to illustrate a particular embodiment of a system that is operable to perform gain control.

Referring to FIG. 1, a particular embodiment of a system that is operable to perform gain control is shown and generally designated 100. In a particular embodiment, the system 100 may be integrated into an encoding system or apparatus (e.g., in a wireless telephone or coder/decoder (CODEC)).

It should be noted that in the following description, various functions performed by the system 100 of FIG. 1 are described as being performed by certain components or modules. However, this division of components and modules is for illustration only. In an alternate embodiment, a function performed by a particular component or module may instead be divided amongst multiple components or modules. Moreover, in an alternate embodiment, two or more components or modules of FIG. 1 may be integrated into a single component or module. Each component or module illustrated in FIG. 1 may be implemented using hardware (e.g., a field-programmable gate array (FPGA) device, an application-specific integrated circuit (ASIC), a digital signal processor (DSP), a controller, etc.), software (e.g., instructions executable by a processor), or any combination thereof.

The system 100 includes an analysis filter bank 110 that is configured to receive an input audio signal 102. For example, the input audio signal 102 may be provided by a microphone or other input device. In a particular embodiment, the input audio signal 102 may include speech. The input audio signal may be a super wideband (SWB) signal that includes data in the frequency range from approximately 50 hertz (Hz) to approximately 16 kilohertz (kHz). The analysis filter bank 110 may filter the input audio signal 102 into multiple portions based on frequency. For example, the analysis filter bank 110 may generate a low-band signal 122 and a high-band signal 124. The low-band signal 122 and the high-band signal 124 may have equal or unequal bandwidths, and may be overlapping or non-overlapping. In an alternate embodiment, the analysis filter bank 110 may generate more than two outputs.

In the example of FIG. 1, the low-band signal 122 and the high-band signal 124 occupy non-overlapping frequency bands. For example, the low-band signal 122 and the high-band signal 124 may occupy non-overlapping frequency bands of 50 Hz-7 kHz and 7 kHz-16 kHz. In an alternate embodiment, the low-band signal 122 and the high-band signal 124 may occupy non-overlapping frequency bands of 50 Hz-8 kHz and 8 kHz-16 kHz. In an yet another alternate embodiment, the low-band signal 122 and the high-band signal 124 may overlap (e.g., 50 Hz-8 kHz and 7 kHz-16 kHz), which may enable a low-pass filter and a high-pass filter of the analysis filter bank 110 to have a smooth rolloff, which may simplify design and reduce cost of the low-pass filter and the high-pass filter. Overlapping the low-band signal 122 and the high-band signal 124 may also enable smooth blending of low-band and high-band signals at a receiver, which may result in fewer audible artifacts.

It should be noted that although the example of FIG. 1 illustrates processing of a SWB signal, this is for illustration only. In an alternate embodiment, the input audio signal 102 may be a wideband (WB) signal having a frequency range of approximately 50 Hz to approximately 8 kHz. In such an embodiment, the low-band signal 122 may correspond to a frequency range of approximately 50 Hz to approximately 6.4 kHz and the high-band signal 124 may correspond to a frequency range of approximately 6.4 kHz to approximately 8 kHz. It should also be noted that the various systems and methods herein are described as detecting high-band noise and performing various operations in response to high-band noise. However, this is for example only. The techniques illustrated with reference to FIGS. 1-6 may also be performed in the context of low-band noise.

The system 100 may include a low-band analysis module 130 configured to receive the low-band signal 122. In a particular embodiment, the low-band analysis module 130 may represent an embodiment of a code excited linear prediction (CELP) encoder. The low-band analysis module 130 may include a linear prediction (LP) analysis and coding module 132, a linear prediction coefficient (LPC) to line spectral pair (LSP) transform module 134, and a quantizer 136. LSPs may also be referred to as line spectral frequencies (LSFs), and the two terms may be used interchangeably herein. The LP analysis and coding module 132 may encode a spectral envelope of the low-band signal 122 as a set of LPCs. LPCs may be generated for each frame of audio (e.g., 20 milliseconds (ms) of audio, corresponding to 320 samples at a sampling rate of 16 kHz), each sub-frame of audio (e.g., 5 ins of audio), or any combination thereof. The number of LPCs generated for each frame or sub-frame may be determined by the "order" of the LP analysis performed. In a particular embodiment, the LP analysis and coding module 132 may generate a set of eleven LPCs corresponding to a tenth-order LP analysis.

The LPC to LSP transform module 134 may transform the set of LPCs generated by the LP analysis and coding module 132 into a corresponding set of LSPs (e.g., using a one-to-one transform). Alternately, the set of LPCs may be one-to-one transformed into a corresponding set of parcor coefficients, log-area-ratio values, immittance spectral pairs (ISPs), or immittance spectral frequencies (ISFs). The transform between the set of LPCs and the set of LSPs may be reversible without error.

The quantizer 136 may quantize the set of LSPs generated by the transform module 134. For example, the quantizer 136 may include or be coupled to multiple codebooks that include multiple entries (e.g., vectors). To quantize the set of LSPs, the quantizer 136 may identify entries of codebooks that are "closest to" (e.g., based on a distortion measure such as least squares or mean square error) the set of LSPs. The quantizer 136 may output an index value or series of index values corresponding to the location of the identified entries in the codebooks. The output of the quantizer 136 may thus represent low-band filter parameters that are included in a low-band bit stream 142.

The low-band analysis module 130 may also generate a low-band excitation signal 144. For example, the low-band excitation signal 144 may be an encoded signal that is generated by quantizing a LP residual signal that is generated during the LP process performed by the low-band analysis module 130. The LP residual signal may represent prediction error.

The system 100 may further include a high-band analysis module 150 configured to receive the high-band signal 124 from the analysis filter bank 110 and the low-band excitation signal 144 from the low-band analysis module 130. The high-band analysis module 150 may generate high-band side information 172 based on the high-band signal 124 and the low-band excitation signal 144. For example, the high-band side information 172 may include high-band LSPs and/or gain information (e.g., based on at least a ratio of high-band energy to low-band energy), as further described herein.

The high-band analysis module 150 may include a high-band excitation generator 160. The high-band excitation generator 160 may generate a high-band excitation signal by extending a spectrum of the low-band excitation signal 144 into the high-band frequency range (e.g., 7 kHz-16 kHz). To illustrate, the high-band excitation generator 160 may apply a transform to the low-band excitation signal (e.g., a non-linear transform such as an absolute-value or square operation) and may mix the transformed low-band excitation signal with a noise signal (e.g., white noise modulated according to an envelope corresponding to the low-band excitation signal 144) to generate the high-band excitation signal. The high-band excitation signal may be used to determine one or more high-band gain parameters that are included in the high-band side information 172.

The high-band analysis module 150 may also include an LP analysis and coding module 152, a LPC to LSP transform module 154, and a quantizer 156. Each of the LP analysis and coding module 152, the transform module 154, and the quantizer 156 may function as described above with reference to corresponding components of the low-band analysis module 130, but at a comparatively reduced resolution (e.g., using fewer bits for each coefficient, LSP, etc.). In another example embodiment, the high band LSP Quantizer 156 may use scalar quantization where a subset of LSP coefficients are quantized individually using a pre-defined number of bits. For example, the LP analysis and coding module 152, the transform module 154, and the quantizer 156 may use the high-band signal 124 to determine high-band filter information (e.g., high-band LSPs) that are included in the high-band side information 172. In a particular embodiment, the high-band side information 172 may include high-band LSPs as well as high-band gain parameters. In the presence of certain types of noise, the high-band gain parameters may be generated as a result of gain attenuation and/or gain smoothing performed by a gain attenuation and smoothing module 162, as further described herein.

The low-band bit stream 142 and the high-band side information 172 may be multiplexed by a multiplexer (MUX) 180 to generate an output bit stream 192. The output bit stream 192 may represent an encoded audio signal corresponding to the input audio signal 102. For example, the output bit stream 192 may be transmitted (e.g., over a wired, wireless, or optical channel) and/or stored. At a receiver, reverse operations may be performed by a demultiplexer (DEMUX), a low-band decoder, a high-band decoder, and a filter bank to generate an audio signal (e.g., a reconstructed version of the input audio signal 102 that is provided to a speaker or other output device). The number of bits used to represent the low-band bit stream 142 may be substantially larger than the number of bits used to represent the high-band side information 172. Thus, most of the bits in the output bit stream 192 represent low-band data. The high-band side information 172 may be used at a receiver to regenerate the high-band signal from the low-band data in accordance with a signal model. For example, the signal model may represent an expected set of relationships or correlations between low-band data (e.g., the low-band signal 122) and high-band data (e.g., the high-band signal 124). Thus, different signal models may be used for different kinds of audio data (e.g., speech, music, etc.), and the particular signal model that is in use may be negotiated by a transmitter and a receiver (or defined by an industry standard) prior to communication of encoded audio data. Using the signal model, the high-band analysis module 150 at a transmitter may be able to generate the high-band side information 172 such that a corresponding high-band analysis module at a receiver is able to use the signal model to reconstruct the high-band signal 124 from the output bit stream 192.

Figure 2:
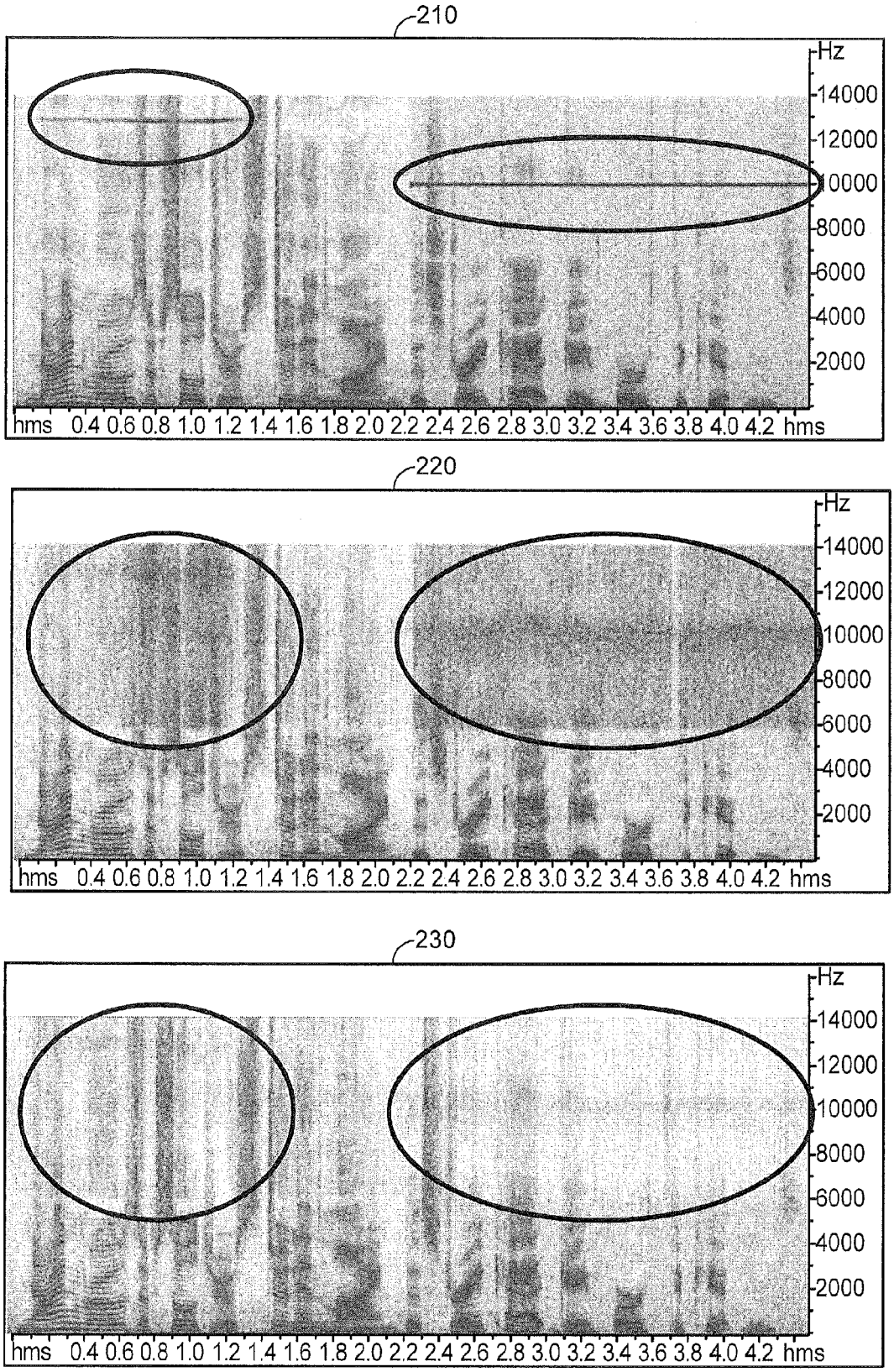
FIG. 2 is a diagram to illustrate examples of artifact-inducing component, a corresponding reconstructed signal that includes artifacts, and a corresponding reconstructed signal that does not include the artifacts.

In the presence of background noise, however, high-band synthesis at the receiver may lead to noticeable artifacts, because insufficient correlation between the low-band and the high-band may cause the underlying signal model to perform sub-optimally in reliable signal reconstruction. For example, the signal model may incorrectly interpret the noise components in high band as speech, and may thus cause generation of gain parameters that attempt to replicate the noise inaccurately at a receiver, leading to the noticeable artifacts. Examples of such artifact-generating conditions include, but are not limited to, high-frequency noises such as automobile horns and screeching brakes. To illustrate, a first spectrogram 210 in FIG. 2 illustrates an audio signal having two components corresponding to artifact-generating conditions, illustrated as high-band noise having a relatively large signal energy. A second spectrogram 220 illustrates the resulting artifacts in the reconstructed signal due to over-estimation of high-band gain parameters.

To reduce such artifacts, the high-band analysis module 150 may perform high-band gain control. For example, the high-band analysis module 150 may include a artifact inducing component detection module 158 that is configured to detect signal components (e.g., the artifact-generating conditions shown in the first spectrogram 210 of FIG. 2) that are likely to result in audible artifacts upon reproduction. In the presence of such components, the high-band analysis module 150 may cause generation of an encoded signal that at least partially reduces an audible effect of such artifacts. For example, the gain attenuation and smoothing module 162 may perform gain attenuation and/or gain smoothing to modify the gain information or parameters included in the high-band side information 172.

Gain attenuation may include reducing a modeled gain value via application of an exponential or linear operation, as illustrative examples. Gain smoothing may include calculating a weighted sum of modeled gains of a current frame/sub-frame and one or more preceding frames/sub-frames. The modified gain information may result in a reconstructed signal according to a third spectrogram 230 of FIG. 2, which is free of (or has a reduced level of) the artifacts shown in the second spectrogram 220 of FIG. 2.

One or more tests may be performed to evaluate whether an audio signal includes an artifact-generating condition. For example, a first test may include comparing a minimum inter-LSP spacing that is detected in a set of LSPs (e.g., LSPs for a particular frame of the audio signal) to a first threshold. A small spacing between LSPs corresponds to a relatively strong signal at a relatively narrow frequency range. In a particular embodiment, when the high-band signal 124 is determined to result in a frame having a minimum inter-LSP spacing that is less than the first threshold, an artifact-generating condition is determined to be present in the audio signal and gain attenuation may be enabled for the frame.

As another example, a second test may include comparing an average minimum inter-LSP spacing for multiple consecutive frames to a second threshold. For example, when a particular frame of an audio signal has a minimum LSP spacing that is greater than the first threshold but less than a second threshold, an artifact-generating condition may still be determined to be present if an average minimum inter-LSP spacing for multiple frames (e.g., a weighted average of the minimum inter-LSP spacing for the four most recent frames including the particular frame) is smaller than a third threshold. As a result, gain attenuation may be enabled for the particular frame.

As another example, a third test may include determining if a particular frame follows a gain-attenuated frame of the audio signal. If the particular frame follows a gain-attenuated frame, gain attenuation may be enabled for the particular frame based on the minimum inter-LSP spacing of the particular frame being less than the second threshold.

Three tests are described for illustrative purposes. Gain attenuation for a frame may be enabled in response to any one or more of the tests (or combinations of the tests) being satisfied or in response to one or more other tests or conditions being satisfied. For example, a particular embodiment may include determining whether or not to enable gain attenuation based on a single test, such as the first test described above, without applying either of the second test or the third test. Alternate embodiments may include determining whether or not to enable gain attenuation based on the second test without applying either of the first test or the third test, or based on the third test without applying either of the first test or the second test. As another example, a particular embodiment may include determining whether or not to enable gain attenuation based on two tests, such as the first test and the second test, without applying the third test. Alternate embodiments may include determining whether or not to enable gain attenuation based on the first test and the third test without applying the second test, or based on the second test and the third test without applying the first test.

When gain attenuation has been enabled for a particular frame, gain smoothing may also be enabled for the particular frame. For example, gain smoothing may be performed by determining an average (e.g., a weighted average) of a gain value for the particular frame and a gain value for a preceding frame of the audio signal. The determined average may be used as the gain value for the particular frame, reducing an amount of change in gain values between sequential frames of the audio signal.

Gain smoothing may be enabled for a particular frame in response to determining that LSP values for the particular frame deviate from a "slow" evolution estimate of the LSP values by less than a fourth threshold and deviate from a "fast" evolution estimate of the LSP values by less than a fifth threshold. An amount of deviation from the slow evolution estimate may be referred to as a slow LSP evolution rate. An amount of deviation from the fast evolution estimate may be referred to as a fast LSP evolution rate and may correspond to a faster adaptation rate than the slow LSP evolution rate.

The slow LSP evolution rate may be based on deviation from a weighted average of LSP values for multiple sequential frames that weights LSP values of one or more previous frames more heavily than LSP values of a current frame. The slow LSP evolution rate having a relatively large value indicates that the LSP values are changing at a rate that is not indicative of an artifact-generating condition. However, the slow LSP evolution rate having a relatively small value (e.g., less than the fourth threshold) corresponds to slow movement of the LSPs over multiple frames, which may be indicative of an ongoing artifact-generating condition.

The fast LSP evolution rate may be based on deviation from a weighted average of LSP values for multiple sequential frames that weights LSP values for a current frame more heavily than the weighted average for the slow LSP evolution rate. The fast LSP evolution rate having a relatively large value may indicate that the LSP values are changing at a rate that is not indicative of an artifact-generating condition, and the fast LSP evolution rate having a relatively small value (e.g., less than the fifth threshold) may correspond to a relatively small change of the LSPs over multiple frames, which may be indicative of an artifact-generating condition.

Although the slow LSP evolution rate may be used to indicate when a multi-frame artifact-generating condition has begun, the slow LSP evolution rate may cause delay in detecting when the multi-frame artifact-generation condition has ended. Similarly, although the fast LSP evolution rate may be less reliable than the slow LSP evolution rate to detect when a multi-frame artifact-generating condition has begun, the fast LSP evolution rate may be used to more accurately detect when a multi-frame artifact-generating condition has ended. A multi-frame artifact-generating event may be determined to be ongoing while the slow LSP evolution rate is less than the fourth threshold and the fast LSP evolution rate is less than the fifth threshold. As a result gain smoothing may be enabled to prevent sudden or spurious increases in frame gain values while the artifact-generating event is ongoing.

In a particular embodiment, the artifact inducing component detection module 158 may determine four parameters from the audio signal to determine whether an audio signal includes a component that will result in audible artifacts—minimum inter-LSP spacing, a slow LSP evolution rate, a fast LSP evolution rate, and an average minimum inter-LSP spacing. For example, a tenth order LP process may generate a set of eleven LPCs that are transformed to ten LSPs. The artifact inducing component detection module 158 may determine, for a particular frame of audio, a minimum (e.g., smallest) spacing between any two of the ten LSPs. Typically, sharp and sudden noises, such as car horns and screeching brakes, result in closely spaced LSPs (e.g., the "strong" 13 kHz noise component in the first spectrogram 210 may be closely surrounded by LSPs at 12.95 kHz and 13.05 kHz). The artifact inducing component detection module 158 may also determine a slow LSP evolution rate and a fast evolution rate, as shown in the following C++-style pseudocode that may be executed by or implemented by the artifact inducing component detection module 158.

```
lsp_spacing = 0.5; //default minimum LSP spacing
gamma1 = 0.7;  //smoothing factor for slow evolution rate
gamma2 = 0.3;  //smoothing factor for fast evolution rate
LPC_ORDER = 10;  //order of linear predictive coding being performed
lsp_slow_evol_rate = 0;
lsp_fast_evol_rate = 0;
for ( i = 0; i < LPC_ORDER; i++ )
```

-continued

```
{ /* Estimate inter-LSP spacing, i.e., LSP distance between the i-th
coefficient and the (i−1)-th LSP coefficient as per below */
  lsp_spacing = min(lsp_spacing,
  ( i = = 0 ? lsp_shb[0] : (lsp_shb[i] − lsp_shb[i −1])));
  /* Estimate the error in LSPs from current frame to past frames */
  lsp_slow_evol_rate = lsp_slow_evol_rate +
                (lsp_shb[i] − lsp_shb_slow_interpl[i])^2;
  lsp_fast_evol_rate = lsp_fast_evol_rate +
                (lsp_shb[i] − lsp_shb_fast_interpl[i])^2;
  /* Update the LSP evolution rates, (slow/fast interpolation LSPs
  for next frame) */
  lsp_shb_slow_interpl[i] = gamma1 * lsp_shb_slow_interpl[i] +
                  (1−gamma1) * lsp_shb[i];
  lsp_shb_fast_interpl[i] = gamma2 *lsp_shb_fast_interpl[i] +
                  (1−gamma2) * lsp_shb[i];
}
```

The artifact inducing component detection module 158 may further determine a weighted-average minimum inter-LSP spacing in accordance with the following pseudocode. The following pseudocode also includes resetting inter-LSP spacing in response to a mode transition. Such mode transitions may occur in devices that support multiple encoding modes for music and/or speech. For example, the device may use an algebraic CELP (ACELP) mode for speech and an audio coding mode, i.e., a generic signal coding (GSC) for music-type signals. Alternately, in certain low-rate scenarios, the device may determine based on feature parameters (e.g., tonality, pitch drift, voicing, etc.) that an ACELP/GSC/modified discrete cosine transform (MDCT) mode may be used.

```
/* LSP spacing reset during mode transitions, i.e., when last frame's
coding mode is different from current frame's coding mode */
THR1 = 0.008;
if(last_mode != current_mode && lsp_spacing < THR1)
{
  lsp_shb_spacing[0] = lsp_spacing;
  lsp_shb_spacing[1] = lsp_spacing;
  lsp_shb_spacing[2] = lsp_spacing;
  prevGainAttenuate = TRUE;
}
/* Compute weighted average LSP spacing over current frame and three
previous frames */
WGHT1 = 0.1; WGHT2 = 0.2; WGHT3 = 0.3; WGHT4 = 0.4;
Average_lsp_shb_spacing =  WGHT1 * lsp_shb_spacing[0] +
                           WGHT2 * lsp_shb_spacing[1] +
                           WGHT3 * lsp_shb_spacing[2] +
                           WGHT4 * lsp_spacing;
/* Update the past lsp spacing buffer */
lsp_shb_spacing[0] = lsp_shb_spacing[1];
lsp_shb_spacing[1] = lsp_shb_spacing[2];
lsp_shb_spacing[2] = lsp_spacing;
```

After determining the minimum inter-LSP spacing, the LSP evolution rates, and the average minimum inter-LSP spacing, the artifact inducing component detection module 158 may compare the determined values to one or more thresholds in accordance with the following pseudocode to determine whether artifact-inducing noise exists in the frame of audio. When artifact-inducing noise exists, the artifact inducing component detection module 158 may enable the gain attenuation and smoothing module 162 to perform gain attenuation and/or gain smoothing as applicable.

```
THR1 = 0.008,
THR2 = 0.0032,
THR3 = 0.005,
THR4 = 0.001,
THR5 = 0.001,
GainAttenuate = FALSE,
GainSmooth = FALSE
/* Check for the conditions below and enable gain attenuate/smooth
parameters.
  If LSP spacing is very small, then there is high confidence that
  artifact-inducing noise exists. */
if (lsp_spacing <= THR2 ||
  (lsp_spacing < THR1 && (Average_lsp_shb_spacing < THR3 ||
                prevGainAttenuate == TRUE)) )
{
  GainAttenuate = TRUE;
  /* Enable gain smoothing depending on evolution rates */
  if( lsp_slow_evol_rate < THR4 && lsp_fast_evol_rate < THR5 ) {
    GainSmooth = TRUE;
  }
}
/* Update previous frame gain attenuation flag to be used in the next
frame */
prevGainAttenuate = GainAttenuate;
```

In a particular embodiment, the gain attenuation and smoothing module 162 may selectively perform gain attenuation and/or smoothing in accordance with the following pseudocode.

```
/* Perform gain smoothing if the following conditions are met*/
gamma3 = 0.5;
if( GainSmooth = = TRUE && prevframe_gain_SHB <
currentframe_gain_SHB )
{
  Gain_SHB = gamma3 * prevframe_gain_SHB +
            (1−gamma3) * currentframe_gain_SHB;
}
/* Perform gain attenuate if the following conditions are met*/
THR6 = 0.0024
K1 = 3;
alpha1 = 0.8;
if( GainAttenuate == TRUE && Average_lsp_shb_spacing <= THR6)
{
  /* if average LSP spacing is less than THR6, which is very small, the
    frame contains a very significant noise component, so use exponential
    weighting */
  Gain_SHB = currentframe_gain_SHB^alpha1;
}
else if (prevGainAttenuate == TRUE && currentframe_gain_SHB >
                K1 * prevframe_gain_SHB)
{
  Gain_SHB = currentframe_gain_SHB * ALPHA1;
}
/* Update previous gain frame to be used in the next frame */
prevframe_gain_SHB = Gain_SHB;
```

The system 100 of FIG. 1 may thus perform gain control (e.g., gain attenuation and/or gain smoothing) to reduce or prevent audible artifacts due to noise in an input signal. The system 100 of FIG. 1 may thus enable more accurate reproduction of an audio signal (e.g., a speech signal) in the presence of noise that is unaccounted for by speech coding signal models.

Figure 3:
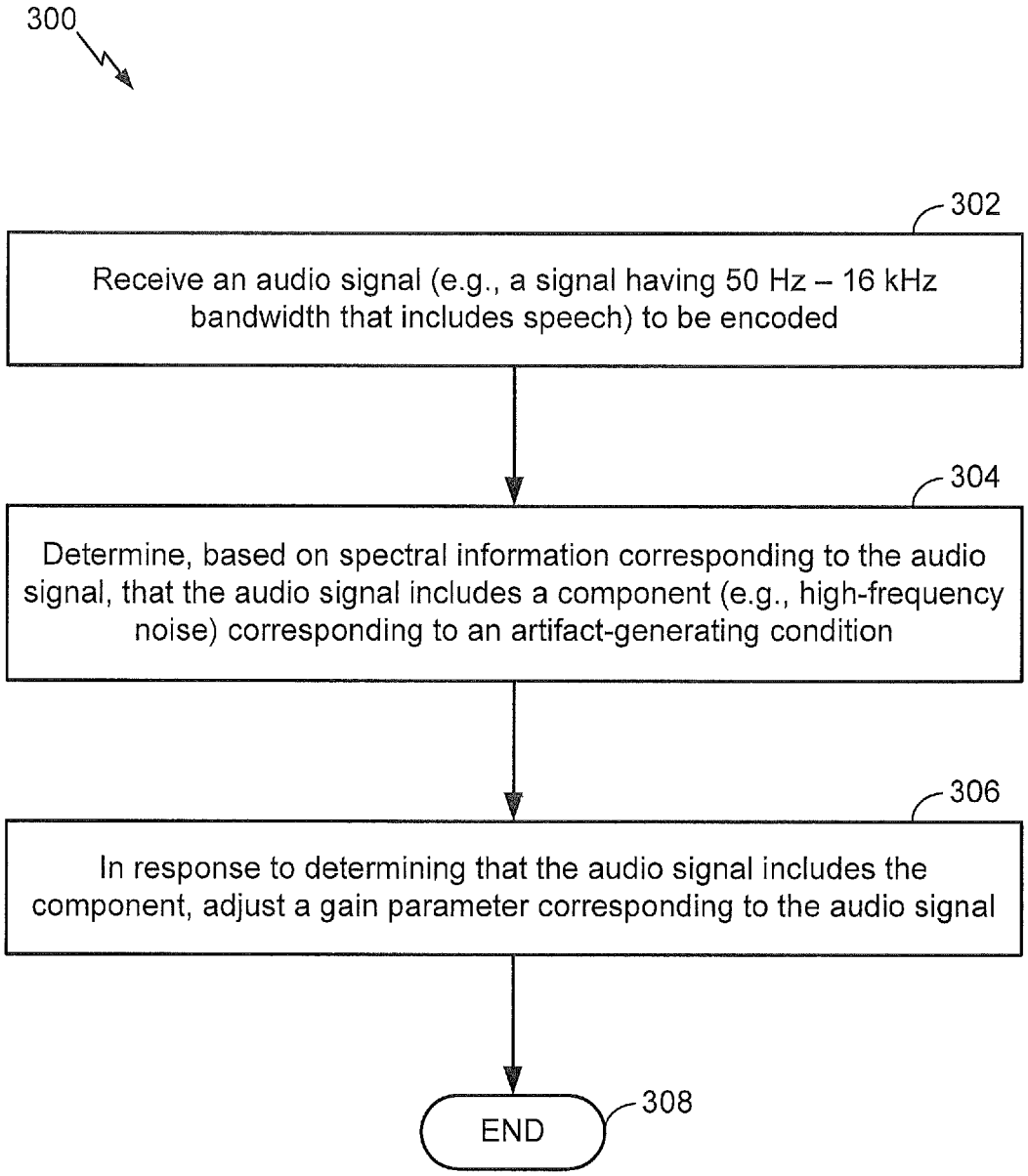
FIG. 3 is a flowchart to illustrate a particular embodiment of a method of performing gain control.

Referring to FIG. 3, a flowchart of a particular embodiment of a method of performing gain control is shown and generally designated 300. In an illustrative embodiment, the method 300 may be performed at the system 100 of FIG. 1.

The method 300 may include receiving an audio signal to be encoded (e.g., via a speech coding signal model), at 302. In a particular embodiment, the audio signal may have a bandwidth from approximately 50 Hz to approximately 16 kHz and may include speech. For example, in FIG. 1, the analysis filter bank 110 may receive the input audio signal 102 that is encoded to be reproduced at a receiver.

The method 300 may also include determining, based on spectral information (e.g., inter-LSP spacing, LSP evolution rate) corresponding to the audio signal, that the audio signal includes a component corresponding to an artifact-generating condition, at 304. In a particular embodiment, the artifact-inducing component may be noise, such as the high-frequency noise shown in the first spectrogram 210 of FIG. 2. For example, in FIG. 1, the artifact inducing component detection module 158 may determine based on spectral information that the high-band portion of the audio signal 102 includes such noise.

Determining that the audio signal includes the component may include determining an inter-LSP spacing associated with a frame of the audio signal. The inter-LSP spacing may be a smallest of a plurality of inter-LSP spacings corresponding to a plurality of LSPs generated during linear predictive coding (LPC) of a high-band portion of the frame of the audio signal. For example, the audio signal can be determined to include the component in response to the inter-LSP spacing being less than a first threshold. As another example, the audio signal can be determined to include the component in response to the inter-LSP spacing being less than a second threshold and an average inter-LSP spacing of multiple frames being less than a third threshold. As described in further detail with respect to FIG. 5, the audio signal may be determined to include the component in response to (1) the inter-LSP spacing being less than a second threshold, and (2) at least one of: an average inter-LSP spacing being less than a third threshold or a gain attenuation corresponding to another frame of the audio signal being enabled, the other frame preceding the frame of the audio signal. Although conditions for determining whether the audio signal includes the component are labeled as (1) and (2), such labels are for reference only and do not impose a sequential order of operation. Instead, conditions (1) and (2) may be determined in any order relative to each other, or concurrently (at least partially overlapping in time).

The method 300 may further include in response to determining that the audio signal includes the component, adjusting a gain parameter corresponding to the audio signal, at 306. For example, in FIG. 1, the gain attenuation and smoothing module 162 may modify the gain information to be included in the high-band side information 172, which results in the encoded output bit stream 192 deviating from the signal model. The method 300 may end, at 308.

Adjusting the gain parameter may include enabling gain smoothing to reduce a gain value corresponding to a frame of the audio signal. In a particular embodiment, the gain smoothing includes determining a weighted average of gain values including the gain value and another gain value corresponding to another frame of the audio signal. The gain smoothing may be enabled in response to a first line spectral pair (LSP) evolution rate associated with the frame being less than a fourth threshold and a second LSP evolution rate associated with the frame being less than a fifth threshold. The first LSP evolution rate (e.g., a 'slow' LSP evolution rate) may correspond to a slower adaptation rate than the second LSP evolution rate (e.g., a 'fast' LSP evolution rate).

Adjusting the gain parameter can include enabling gain attenuation to reduce a gain value corresponding to a frame of the audio signal. In a particular embodiment, gain attenuation includes applying an exponential operation to the gain value or applying a linear operation to the gain value. For example, in response to a first gain condition being satisfied (e.g., the frame includes an average inter-LSP spacing less than a sixth threshold), an exponential operation may be applied to the gain value. In response to a second gain condition being satisfied (e.g., a gain attenuation corresponding to another frame of the audio signal being enabled, the other frame preceding the frame of the audio signal), a linear operation may be applied to the gain value. In particular embodiments, the method 300 of FIG. 3 may be implemented via hardware (e.g., a field-programmable gate array (FPGA) device, an application-specific integrated circuit (ASIC), etc.) of a processing unit such as a central processing unit (CPU), a digital signal processor (DSP), or a controller, via a firmware device, or any combination thereof. As an example, the method 300 of FIG. 3 can be performed by a processor that executes instructions, as described with respect to FIG. 6.

Figure 4:
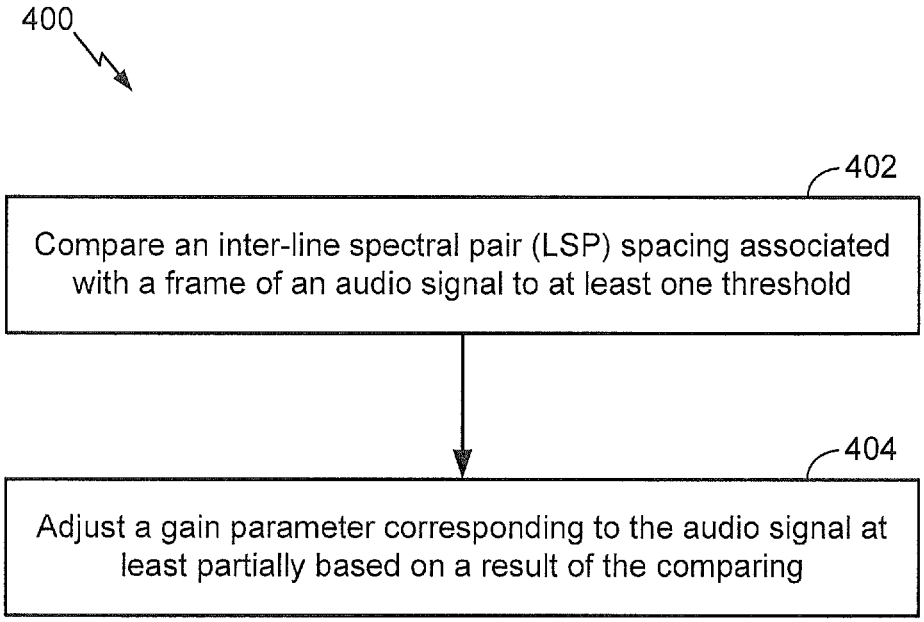
FIG. 4 is a flowchart to illustrate another particular embodiment of a method of performing gain control.

Referring to FIG. 4, a flowchart of a particular embodiment of a method of performing gain control is shown and generally designated 400. In an illustrative embodiment, the method 400 may be performed at the system 100 of FIG. 1.

An inter-line spectral pair (LSP) spacing associated with a frame of an audio signal is compared to at least one threshold, at 402, and a gain parameter corresponding to the audio signal is adjusted at least partially based on a result of the comparing, at 404. Although comparing the inter-LSP spacing to at least one threshold may indicate the presence of an artifact-generating component in the audio signal, the comparison need not indicate the actual presence of an artifact-generating component. For example, one or more thresholds used in the comparison may be set to provide an increased likelihood that gain control is performed when an artifact-generating component is present in the audio signal while also providing an increased likelihood that gain control is performed without an artifact-generating component being present in the audio signal (e.g., a 'false positive'). Thus, the method 400 may perform gain control without determining whether an artifact-generating component is present in the audio signal.

In a particular embodiment, the inter-LSP spacing is a smallest of a plurality of inter-LSP spacings corresponding to a plurality of LSPs of a high-band portion of the frame of the audio signal. Adjusting the gain parameter may include enabling gain attenuation in response to the inter-LSP spacing being less than a first threshold. Alternatively, or in addition, adjusting the gain parameter includes enabling gain attenuation in response to the inter-LSP spacing being less than a second threshold and an average inter-LSP spacing being less than a third threshold, where the average inter-LSP spacing is based on the inter-LSP spacing associated with the frame and at least one other inter-LSP spacing associated with at least one other frame of the audio signal.

When gain attenuation is enabled, adjusting the gain parameter may include applying an exponential operation to a value of the gain parameter in response to a first gain condition being satisfied and applying a linear operation to the value of the gain parameter in response to a second gain condition being satisfied.

Adjusting the gain parameter may include enabling gain smoothing to reduce a gain value corresponding to a frame of the audio signal. Gain smoothing may include determining a weighted average of gain values including the gain value associated with the frame and another gain value corresponding to another frame of the audio signal. Gain smoothing may be enabled in response to a first line spectral pair (LSP) evolution rate associated with the frame being less than a fourth threshold and a second LSP evolution rate associated with the frame being less than a fifth threshold. The first LSP evolution rate corresponds to a slower adaptation rate than the second LSP evolution rate.

In particular embodiments, the method 400 of FIG. 4 may be implemented via hardware (e.g., a field-programmable gate array (FPGA) device, an application-specific integrated circuit (ASIC), etc.) of a processing unit, such as a central processing unit (CPU), a digital signal processor (DSP), or a controller, via a firmware device, or any combination thereof. As an example, the method 400 of FIG. 4 can be performed by a processor that executes instructions, as described with respect to FIG. 6.

Figure 5:
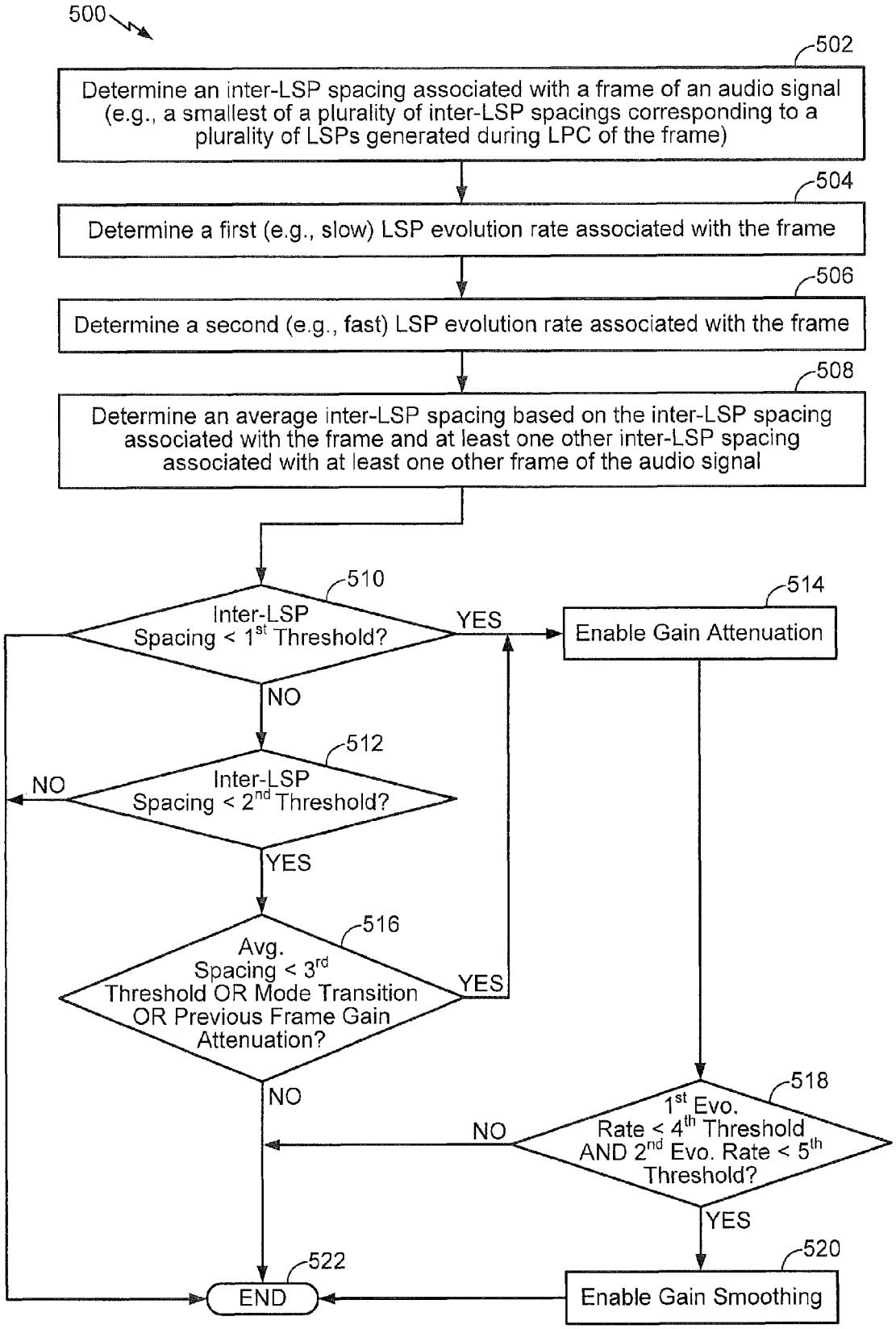
FIG. 5 is a flowchart to illustrate another particular embodiment of a method of performing gain control.

Referring to FIG. 5, a flowchart of another particular embodiment of a method of performing gain control is shown and generally designated 500. In an illustrative embodiment, the method 500 may be performed at the system 100 of FIG. 1.

The method 500 may include determining an inter-LSP spacing associated with a frame of an audio signal, at 502. The inter-LSP spacing may be the smallest of a plurality of inter-LSP spacings corresponding to a plurality of LSPs generated during a linear predictive coding of the frame. For example, the inter-LSP spacing may be determined as illustrated, with reference to the "lsp_spacing" variable in the pseudocode corresponding to FIG. 1.

The method 500 may also include determining a first (e.g., slow) LSP evolution rate associated with the frame, at 504, and determining a second (e.g., fast) LSP evolution rate associated with the frame, at 506. For example, the LSP evolution rates may be determined as illustrated with reference to the "lsp_slow_evol_rate" and "lsp_fast_evol_rate" variables in the pseudocode corresponding to FIG. 1.

The method 500 may further include determining an average inter-LSP spacing based on the inter-LSP spacing associated with the frame and at least one other inter-LSP spacing associated with at least one other frame of the audio signal, at 508. For example, the average inter-LSP spacing may be determined as illustrated with reference to the "Average_lsp_shb spacing" variable in the pseudocode corresponding to FIG. 1.

The method 500 may include determining whether the inter-LSP spacing is less than a first threshold, at 510. For example, in the pseudocode of FIG. 1, the first threshold may be "THR2"=0.0032. When the inter-LSP spacing is less than the first threshold, the method 500 may include enabling gain attenuation, at 514.

When the inter-LSP spacing is not less than the first threshold, the method 500 may include determining whether the inter-LSP spacing is less than a second threshold, at 512. For example, in the pseudocode of FIG. 1, the second threshold may be "THR1"=0.008. When the inter-LSP spacing is not less than the second threshold, the method 500 may end, at 522. When the inter-LSP spacing is less than the second threshold, the method 500 may include determining if the average inter-LSP spacing is less than a third threshold, if the frame represents (or is otherwise associated with) a mode transition, and/or if the gain attenuation was enabled in the previous frame, at 516. For example, in the pseudocode of FIG. 1, the third threshold may be "THR3"=0.005. When the average inter-LSP spacing is less than the third threshold or the frame represents a mode transition or if the variable prevGainAttenuate=TRUE, the method 500 may include enabling gain attenuation, at 514. When the average inter-LSP spacing is not less than the third threshold and the frame does not represent a mode transition and the variable prevGainAttenuate=FALSE, the method 500 may end, at 522.

When gain attenuation is enabled at 514, the method 500 may advance to 518 and determine whether the first evolution rate is less than a fourth threshold and the second evolution rate is less than a fifth threshold, at 518. For example, in the pseudocode of FIG. 1, the fourth threshold may be "THR4"=0.001 and the fifth threshold may be "THR5"=0.001. When the first evolution rate is less than the fourth threshold and the second evolution rate is less than the fifth threshold, the method 500 may include enabling gain smoothing, at 520, after which the method 500 may end, at 522. When the first evolution rate is not less than the fourth threshold or the second evolution rate is not less than the fifth threshold, the method 500 may end, at 522.

In particular embodiments, the method 500 of FIG. 5 may be implemented via hardware (e.g., a field-programmable gate array (FPGA) device, an application-specific integrated circuit (ASIC), etc.) of a processing unit such as a central processing unit (CPU), a digital signal processor (DSP), or a controller, via a firmware device, or any combination thereof. As an example, the method 500 of FIG. 5 can be performed by a processor that executes instructions, as described with respect to FIG. 6.

FIGS. 1-5 thus illustrate systems and methods of determining whether to perform gain control (e.g., at the gain attenuation and smoothing module 162 of FIG. 1) to reduce artifacts due to noise.

Figure 6:
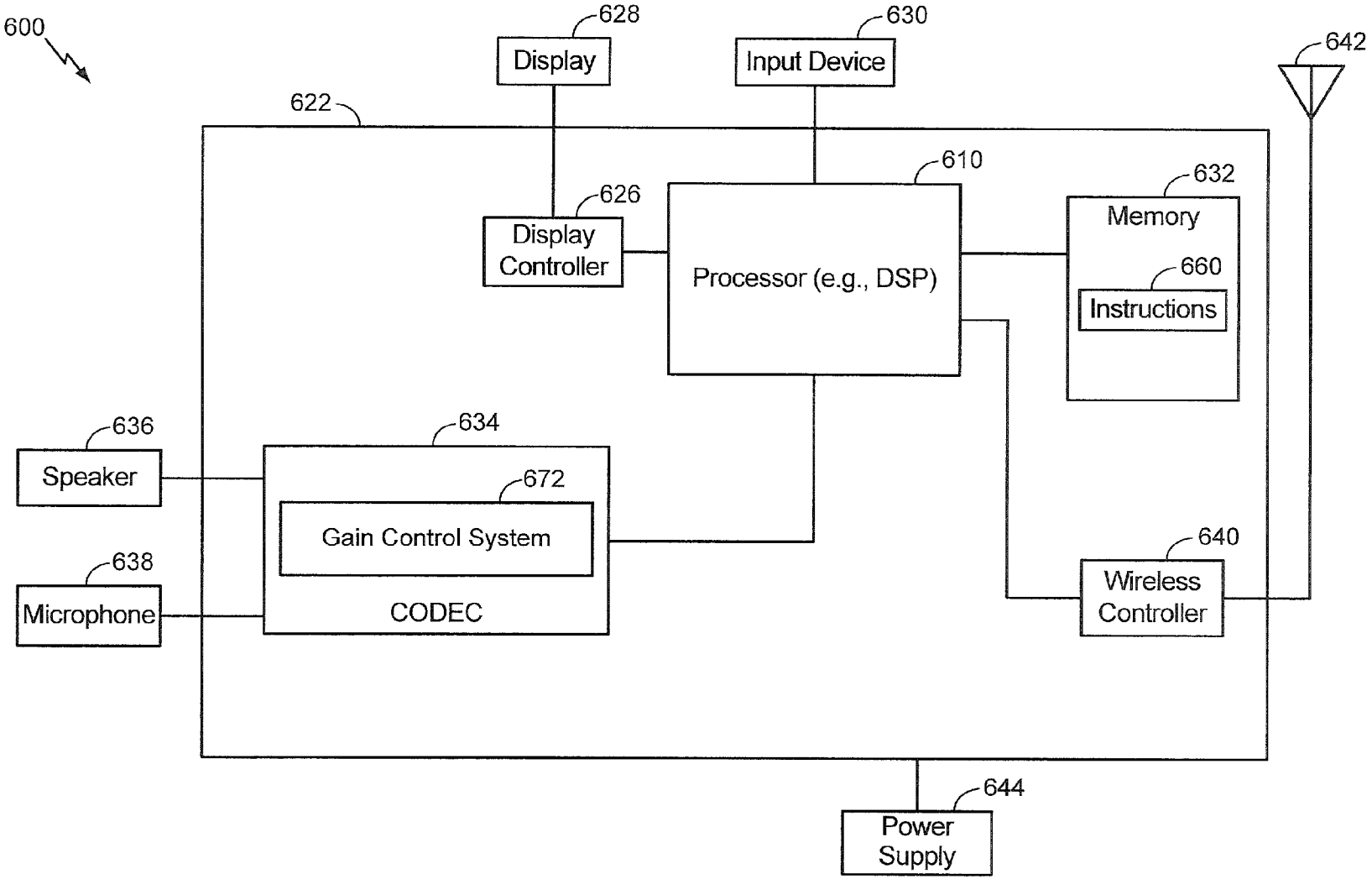
FIG. 6 is a block diagram of a wireless device operable to perform signal processing operations in accordance with the systems and methods of FIGS. 1-5.

Referring to FIG. 6, a block diagram of a particular illustrative embodiment of a wireless communication device is depicted and generally designated 600. The device 600 includes a processor 610 (e.g., a central processing unit (CPU), a digital signal processor (DSP), etc.) coupled to a memory 632. The memory 632 may include instructions 660 executable by the processor 610 and/or a coder/decoder (CODEC) 634 to perform methods and processes disclosed herein, such as the methods of FIGS. 3-5.

The CODEC 634 may include a gain control system 672. In a particular embodiment, the gain control system 672 may include one or more components of the system 100 of FIG. 1. The gain control system 672 may be implemented via dedicated hardware (e.g., circuitry), by a processor executing instructions to perform one or more tasks, or a combination thereof. As an example, the memory 632 or a memory in the CODEC 634 may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 660) that, when executed by a computer (e.g., a processor in the CODEC 634 and/or the processor 610), may cause the computer to determine, based on spectral information corresponding to an audio signal, that the audio signal includes a component corresponding to an artifact-generating condition and to adjust a gain parameter corresponding to the audio signal in response to determining that the audio signal includes the component. As an example, the memory 632 or a memory in the CODEC 634 may be a non-transitory computer-readable medium that includes instructions (e.g., the instructions 660) that, when executed by a computer (e.g., a processor in the CODEC 634 and/or the processor 610), may cause the computer to compare an inter-line spectral pair (LSP) spacing associated with a frame of an audio signal to at least one threshold and to adjust an audio encoding gain parameter corresponding to the audio signal at least partially based on a result of the comparing.

FIG. 6 also shows a display controller 626 that is coupled to the processor 610 and to a display 628. The CODEC 634 may be coupled to the processor 610, as shown. A speaker 636 and a microphone 638 can be coupled to the CODEC 634. For example, the microphone 638 may generate the input audio signal 102 of FIG. 1, and the CODEC 634 may generate the output bit stream 192 for transmission to a receiver based on the input audio signal 102. As another example, the speaker 636 may be used to output a signal reconstructed by the CODEC 634 from the output bit stream 192 of FIG. 1, where the output bit stream 192 is received from a transmitter. FIG. 6 also indicates that a wireless controller 640 can be coupled to the processor 610 and to a wireless antenna 642.

In a particular embodiment, the processor 610, the display controller 626, the memory 632, the CODEC 634, and the wireless controller 640 are included in a system-in-package or system-on-chip device (e.g., a mobile station modem (MSM)) 622. In a particular embodiment, an input device 630, such as a touchscreen and/or keypad, and a power supply 644 are coupled to the system-on-chip device 622. Moreover, in a particular embodiment, as illustrated in FIG. 6, the display 628, the input device 630, the speaker 636, the microphone 638, the wireless antenna 642, and the power supply 644 are external to the system-on-chip device 622. However, each of the display 628, the input device 630, the speaker 636, the microphone 638, the wireless antenna 642, and the power supply 644 can be coupled to a component of the system-on-chip device 622, such as an interface or a controller.

In conjunction with the described embodiments, an apparatus is disclosed that includes means for determining, based on spectral information corresponding to an audio signal, that the audio signal includes a component corresponding to an artifact-generating condition. For example, the means for determining may include the artifact inducing component detection module 158 of FIG. 1, the gain control system 672 of FIG. 6 or a component thereof, one or more devices configured to determine that an audio signal includes such a component (e.g., a processor executing instructions at a non-transitory computer readable storage medium), or any combination thereof.

The apparatus may also include means for adjusting a gain parameter corresponding to the audio signal in response to determining that the audio signal includes the component. For example, the means for adjusting may include the gain attenuation and smoothing module 162 of FIG. 1, the gain control system 672 of FIG. 6 or a component thereof, one or more devices configured to generate an encoded signal (e.g., a processor executing instructions at a non-transitory computer readable storage medium), or any combination thereof.

Those of skill would further appreciate that the various illustrative logical blocks, configurations, modules, circuits, and algorithm steps described in connection with the embodiments disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the embodiments disclosed herein may be embodied directly in hardware, in a software module executed by a processor, or in a combination of the two. A software module may reside in a memory device, such as random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an application-specific integrated circuit (ASIC). The ASIC may reside in a computing device or a user terminal. In the alternative, the processor and the storage medium may reside as discrete components in a computing device or a user terminal.

The previous description of the disclosed embodiments is provided to enable a person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined by the following claims.

What is claimed is:

1. A method comprising:

determining a minimum inter-line spectral pair (LSP) spacing of high-band LSPs of a frame of a received audio signal;

based on the minimum inter-LSP spacing, determining that a high-band portion of the received audio signal includes a component corresponding to an artifact-generating condition, the received audio signal determined to include the component at least partially in response to the minimum inter-LSP spacing satisfying a threshold;

in response to determining that the high-band portion of the received audio signal includes the component, adjusting a high-band gain parameter corresponding to the high-band portion of the received audio signal; and generating an output bit stream, the output bit stream generated based on the adjusted high-band gain parameter.

2. The method of claim 1, wherein determining the minimum inter-LSP spacing, determining that the high-band portion of the received audio signal includes the component, adjusting the high-band gain parameter, and generating the output bit stream are performed in a device that comprises a mobile communication device.

3. The method of claim 1, further comprising transmitting the output bit stream to an electronic device.

4. The method of claim 1, wherein the received audio signal is further determined to include the component in response to an average inter-LSP spacing being less than an average inter-LSP spacing threshold, and wherein the average inter-LSP spacing is based on an inter-LSP spacing associated with the frame and at least one other inter-LSP spacing associated with at least one other frame of the received audio signal.

5. The method of claim 1, wherein the received audio signal is further determined to include the component in response to at least one of: an average inter-LSP spacing being less than an average inter-LSP spacing threshold or a gain attenuation corresponding to another frame of the received audio signal being enabled, the other frame preceding the frame.

6. The method of claim 1, wherein adjusting the high-band gain parameter includes enabling gain smoothing to reduce faster variations in a gain value corresponding to the frame.

7. The method of claim 6, wherein the gain smoothing includes determining a weighted average of gain values including the gain value associated with the frame and another gain value corresponding to another frame of the received audio signal.

8. The method of claim 6, wherein the gain smoothing is enabled in response to a first LSP evolution rate associated with the frame being less than a threshold and a second LSP evolution rate associated with the frame being less than another threshold, and wherein the first LSP evolution rate corresponds to a slower adaptation rate than the second LSP evolution rate.

9. The method of claim 1, wherein determining the minimum inter-LSP spacing, determining that the high-band portion of the received audio signal includes the component, adjusting the high-band gain parameter, and generating the output bit stream are performed in a device that comprises a fixed location communication device.

10. The method of claim 1, wherein adjusting the high-band gain parameter includes enabling gain attenuation to reduce a gain value corresponding to the frame.

11. The method of claim 10, wherein the gain attenuation includes applying an exponential operation to the gain value.

12. The method of claim 10, wherein the gain attenuation includes applying a linear operation to the gain value.

13. The method of claim 10, wherein the gain attenuation includes:

in response to a first gain condition being satisfied, applying an exponential operation to the gain value; and in response to a second gain condition being satisfied, applying a linear operation to the gain value.

14. The method of claim 13, wherein the first gain condition includes an average inter-LSP spacing being less than a threshold, and wherein the average inter-LSP spacing is based on an inter-LSP spacing associated with the frame and at least one other inter-LSP spacing associated with at least one other frame of the received audio signal.

15. The method of claim 13, wherein the second gain condition includes a gain attenuation corresponding to another frame of the received audio signal being enabled, the other frame preceding the frame.

16. The method of claim 1, wherein the artifact-generating condition corresponds to high-band noise.

17. A method comprising:

determining a minimum inter-line spectral pair (LSP) spacing of high-band LSPs of a frame of a received audio signal;

comparing the minimum inter-LSP spacing to at least one threshold;

adjusting a high-band gain parameter corresponding to a high-band portion of the received audio signal at least partially based on a result of the comparing; and generating an output bit stream, the output bit stream generated based on the adjusted high-band gain parameter.

18. The method of claim 17, wherein the determining, the comparing, the adjusting, and the generating are performed in a device that comprises a mobile communication device.

19. The method of claim 17, wherein adjusting the high-band gain parameter includes enabling gain attenuation in response to the minimum inter-LSP spacing being less than a threshold.

20. The method of claim 17, wherein adjusting the high-band gain parameter includes enabling gain attenuation in response to the minimum inter-LSP spacing being less than a first threshold and an average inter-LSP spacing being less than a second threshold, and wherein the average inter-LSP spacing is based on an inter-LSP spacing associated with the frame and at least one other inter-LSP spacing associated with at least one other frame of the received audio signal.

21. The method of claim 17, wherein adjusting the high-band gain parameter includes, when gain attenuation is enabled:

in response to a first gain condition being satisfied, applying an exponential operation to a value of the high-band gain parameter; and in response to a second gain condition being satisfied, applying a linear operation to the value of the high-band gain parameter.

22. The method of claim 17, wherein the determining, the comparing, the adjusting, and the generating are performed in a device that comprises a fixed location communication device.

23. The method of claim 17, wherein adjusting the high-band gain parameter includes enabling gain smoothing to reduce faster variations in a gain value corresponding to the frame, wherein the gain smoothing includes determining a weighted average of gain values including the gain value corresponding to the frame and another gain value corresponding to another frame of the received audio signal, wherein the gain smoothing is enabled in response to a first LSP evolution rate associated with the frame being less than a fourth threshold and a second LSP evolution rate associated with the frame being less than a fifth threshold, and wherein the first LSP evolution rate corresponds to a slower adaptation rate than the second LSP evolution rate.

24. An apparatus comprising:

a noise detection circuit configured to determine a minimum inter-line spectral pair (LSP) spacing of high-band LSPs of a frame of a received audio signal and to determine, based on the minimum inter-LSP spacing, that a high-band portion of the received audio signal includes a component corresponding to an artifact-generating condition;

a gain attenuation and smoothing circuit responsive to the noise detection circuit and configured to, in response to the determination that the high-band portion of the received audio signal includes the component, adjust a high-band gain parameter corresponding to the high-band portion of the received audio signal; and an output terminal configured to output a bit stream generated based on the adjusted high-band gain parameter.

25. The apparatus of claim 24, further comprising:

an analysis filter bank configured to receive the received audio signal and to generate a low-band portion of the received audio signal and the high-band portion of the received audio signal;

a low-band analysis circuit configured to generate a low-band bit stream based on the low-band portion of the received audio signal; and a high-band analysis circuit configured to generate high-band side information based on the high-band portion of the received audio signal and a low-band excitation associated with the low-band portion of the received audio signal, wherein the high-band gain parameter is included in the high-band side information.

26. The apparatus of claim 24, further comprising:

an antenna; and a receiver coupled to the antenna and configured to receive the audio signal.

27. The apparatus of claim 26, wherein the noise detection circuit, the gain attenuation and smoothing circuit, the receiver, and the antenna are integrated into a mobile communication device.

28. The apparatus of claim 26, wherein the noise detection circuit, the gain attenuation and smoothing circuit, the receiver, and the antenna are integrated into a fixed location communication device.

29. An apparatus comprising:

means for determining a minimum inter-line spectral pair (LSP) spacing of high-band LSPs of a frame of a received audio signal and for determining, based on the minimum inter-LSP spacing, that a high-band portion of the received audio signal includes a component corresponding to an artifact-generating condition, the received audio signal determined to include the component in response to the minimum inter-LSP spacing satisfying a threshold;

means for adjusting a high-band gain parameter corresponding to the high-band portion of the received audio signal in response to the means for determining indicating that the high-band portion of the received audio signal includes the component; and means for outputting an output bit stream generated based on the adjusted high-band gain parameter.

30. The apparatus of claim 29, further comprising:

means for generating a low-band portion of the received audio signal and the high-band portion of the received audio signal;

means for generating a low-band bit stream based on the low-band portion of the received audio signal; and means for generating high-band side information based on the high-band portion of the received audio signal and a low-band excitation associated with the low-band portion of the received audio signal, wherein the high-band gain parameter is included in the high-band side information.

31. The apparatus of claim 29, wherein the means for determining, the means for adjusting, and the means for outputting are integrated into a fixed location communication device.

32. The apparatus of claim 29, wherein the means for determining, the means for adjusting, and the means for outputting are integrated into a mobile communication device.

33. A non-transitory computer-readable medium comprising instructions that, when executed by a computer, cause the computer to:

determine a minimum inter-line spectral pair (LSP) spacing of high-band LSPs of a frame of a received audio signal;

based on the minimum inter-LSP spacing, determine that a high-band portion of the received audio signal includes a component corresponding to an artifact-generating condition, the received audio signal determined to include the component at least partially in response to the minimum inter-LSP spacing satisfying a threshold;

adjust a high-band gain parameter corresponding to the high-band portion of the received audio signal in response to the determination that the high-band portion of the received audio signal includes the component; and generate an output bit stream, the output bit stream generated based on the adjusted high-band gain parameter.

34. The non-transitory computer-readable medium of claim 33, wherein adjusting the high-band gain parameter includes enabling gain attenuation in response to the minimum inter-LSP spacing being less than the threshold.

35. The non-transitory computer-readable medium of claim 33, wherein adjusting the high-band gain parameter includes enabling gain attenuation in response to an average inter-LSP spacing being less than an average inter-LSP spacing threshold, and wherein the average inter-LSP spacing is based on an inter-LSP spacing associated with the frame and at least one other inter-LSP spacing associated with at least one other frame of the received audio signal.

36. The non-transitory computer-readable medium of claim 33, wherein adjusting the high-band gain parameter includes, when gain attenuation is enabled:

in response to a first gain condition being satisfied, applying an exponential operation to a value of the high-band gain parameter; and in response to a second gain condition being satisfied, applying a linear operation to the value of the high-band gain parameter.

37. The non-transitory computer-readable medium of claim 33, wherein adjusting the high-band gain parameter includes enabling gain smoothing to reduce faster variations in a gain value corresponding to the frame, wherein the gain smoothing includes determining a weighted average of gain values including the gain value corresponding to the frame and another gain value corresponding to another frame of the received audio signal, wherein the gain smoothing is enabled in response to a first LSP evolution rate associated with the frame being less than a first LSP evolution rate threshold and a second LSP evolution rate associated with the frame being less than a second LSP evolution rate threshold, and wherein the first LSP evolution rate corresponds to a slower adaptation rate than the second LSP evolution rate.

* * * * *